United States Patent [19]

Arians

[11] Patent Number: 4,644,689

[45] Date of Patent: Feb. 24, 1987

[54] SANITARY DEVICE

[76] Inventor: Michael W. Arians, Rte. 2, Box 227, Elgin, Ill. 60120

[21] Appl. No.: 809,402

[22] Filed: Dec. 16, 1985

[51] Int. Cl.[4] ..... E06B 7/00

[52] U.S. Cl. ..... 49/70; 206/233; 206/494; 221/102

[58] Field of Search ..... 49/70; 206/233, 235, 206/216, 494, 225; 220/1 T; 221/97, 102

[56] References Cited

U.S. PATENT DOCUMENTS

| | | | |
|---|---|---|---|
| 1,688,242 | 10/1928 | Lawrence et al. | 221/102 X |
| 1,810,784 | 6/1931 | Pavelka | 49/70 X |
| 1,994,394 | 3/1935 | Horwitt | 206/16 |
| 2,007,042 | 7/1935 | Duckett | 206/1 |
| 2,415,588 | 2/1947 | Gui | 206/38 |
| 2,710,732 | 6/1955 | Peters | 49/70 X |
| 2,841,275 | 7/1958 | Schwimmer et al. | 206/57 |
| 2,965,427 | 12/1960 | Sessions | 221/102 X |
| 3,089,586 | 5/1963 | Cole | 206/494 X |
| 3,414,157 | 12/1968 | Wright | 221/102 X |
| 4,280,643 | 7/1981 | Cordova et al. | 206/225 X |

*Primary Examiner*—Philip C. Kannan

*Attorney, Agent, or Firm*—Mathew R. P. Perrone, Jr.

[57] ABSTRACT

A sanitary device combining a receptacle and a disposable paper dispenser is suitable for mounting on a door.

9 Claims, 2 Drawing Figures

SANITARY DEVICE

BACKGROUND OF THE INVENTION

This invention relates to a device for improving sanitary conditions, and more particularly to a combination of a dispenser and a receptacle suitable for being mounted on a door.

In this heavily populated world, sanitation contributes to the health of all people. Accordingly, many devices are known which attempt to deal with the problems of sanitation, from many standpoints including—but not limited to—a personal standpoint, a medical standpoint and an industrial standpoint.

From a personal standpoint, the sanitation in public lavatories is an important factor to most people. Not only must the facility itself appear clean and be clean, certain touched surfaces must be substantially clean or protected at most times. In many cases, this cleanliness is accomplished by a disposable paper product.

Even the door opening and closing apparatus in a public lavatory may be offensive to some people, without some sort of disposable protection. Yet, disposable protection for a door apparatus may create a problem of its own if there is no simple way to obtain and to dispose of the protection. Absent such a simple manner of disposing of the protection, a litter problem can be created.

An additional consideration is the amount of space available for a device used for sanitation purposes. In public places, space is always at a premium. It is, therefore, desirable to have sanitation devices require a minimal amount of space—while recognizing that any sanitation device of appropriate size requires space. The solution for one problem of space requirement interferes with the solution for the other problem of space limitation.

Also, a sanitation device must not interfere with the function of the other apparatus used in a public lavatory. Such interference can violate health codes and cause other problems, as well as create more problems than it solves.

Even better for use in public facilities is device that combines functions of many devices. In this fashion, space requirements can be minimized, and several problems solved.

On the industrial scene, additional problems occur above and beyond the problems listed and are additional thereto. In short, sanitation is an even more present requirement due to greater danger. Materials handled in a controlled area can sometimes be lethal. In this situation, sanitation becomes an even more stringent requirement.

Another problem area in the use of doors can be in the medical field. Sterile handling of a door may be even more critical than in other fields. Health of individuals is even more critical in such situations.

It is, therefore, desirable to provide temporary and disposable protection for door opening devices.

SUMMARY OF THE INVENTION

Therefore, it is an object of this invention to provide a new and improved sanitary device.

A further object of this invention is to provide a device which contributes to improved personal sanitation.

Still, a further object of this invention is to provide device which has a simple manner of obtaining disposable protection.

Yet, a further object of this invention is to provide a device which has a simple manner of disposing of disposable protection.

Also an object of this invention is to provide a device which has appropriate size.

Another object of this invention is to provide a device which requires minimal space.

Still another object of this invention is to provide a device which provides protection from lethal materials.

Yet another object of this invention is to provide a device which does not interfere with other required functions.

A further object of this invention is to provide a device which combines the functions of a plurality of devices into one device and eliminates the need for a plurality of devices.

Still, a further object of this invention is to provide a device suitable for use in industrial sanitation.

Yet, a further object of this invention is to provide a device suitable for use in medical sanitation.

These and other objects of this invention (which will become clear from considering this application as a whole) are satisfied by providing a sanitary device capable of being mounted on a door, and including in one unit a dispenser of disposable protection and an appropriate receptacle for receiving the used protection.

BRIEF DESCRIPTION OF THE DRAWING

Throughout the Figures of the drawing, where the same part appears in more than one Figure, the same numeral is assigned to that part.

DESCRIPTION OF THE PREFERRED EMBODIMENTS

A door assembly including a door and a sanitary door protector is suitable for use in public facilities and industrial or medical facilities.

Figure 1:
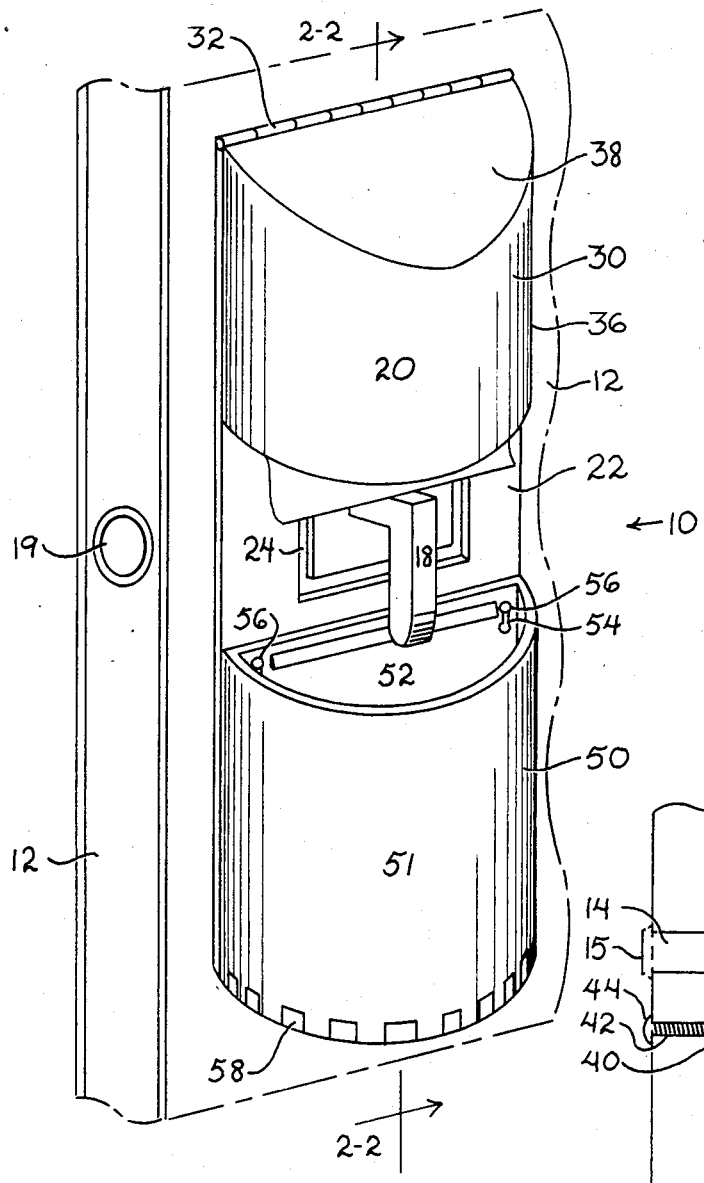
FIG. 1 is a perspective view of door assembly 10.
Figure 2:
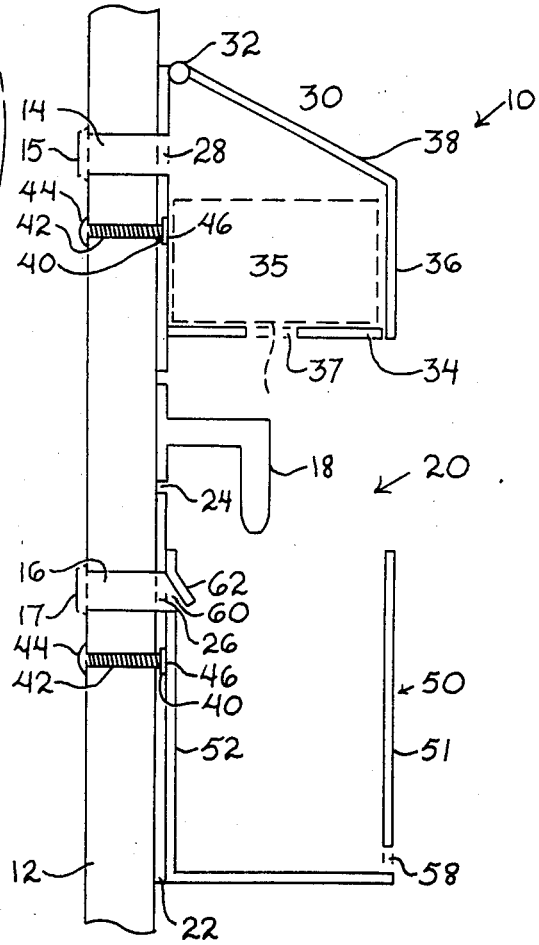
FIG. 2 is a cross-section of door assembly 10 along Line 2—2 of FIG. 1.

Figure I depicts a perspective view of door assembly 10, and includes a door 12 and a sanitary door protector 20. Door 12 (more clearly shown in FIG. 2) is suitable for use on a public lavatory or similar facility. Door 12 can furthermore be suitable for industrial use—for example in a hazardous chemical area or similar place. Included in door 12 is an upper door vent 14 and upper door vent cover 15 situated near the top of door 12. Also within door 12 is lower door vent 16 and lower vent cover 17. Upper vent cover 15 and lower vent cover 17 are decorative or utilitarian, and are generally on the side of door 12 opposite the side of door 12 on which door protector 20 is secured, in a standard fashion as shown. In some areas, a door is required to have vents—which is the reason for including vents herein. Door protector 20 does not interfere with doors which are required to be vented and in fact uses the vent air flow to assist disposal. Upper door vent cover 15 and lower door vent cover 17 completely cover upper door vent 14 and lower door vent 16 respectively. Door handle 18 is operatively connected to door closing mechanism 19. Of course other door mechanisms may be used.

Mounted on door 12 is sanitary door protector 20. Sanitary door protector 20 includes mounting plate 22 secured directly to door 12. Within mounting plate 22 is door handle aperture 24 of sufficient size to permit door handle 18 to fit therethrough without interfering with the function thereof. Lower plate vent 26 is within mounting plate 22 and corresponds to lower door vent 16. Upper plate vent 28 is within mounting plate 22 and corresponds to upper door vent 14. Thus, mounting plate 22 does not interfere with air flow door 12. If door 12 does not require airflow, vents are appropriately omitted.

Adjacent upper plate vent 28 is tissue cover 30. Tissue cover 30 is connected to mounting plate 22 at the top thereof by hinge 32. Opposite cover hinge 32 is tissue mount 34 supporting tissue box 35. Arcuate tissue cover frontpiece 36 provides a front view of tissue cover 30. Sloped tissue top 38 makes that part of the sanitary door protector easier to clean. Thus tissue cover 30 includes sloped tissue top 38, with arcuate tissue cover frontpiece 36 as a part thereof and forming a basis for supporting tissue mount 34. Tissue mount 34 may be secured to mounting plate 22 or arcuate tissue cover front 36 and opposite sloped tissue top 38. Hinge 32 permits upward movement of the tissue cover 30 for changing the tissue box 35. Slot 37 provides for tissue removal from tissue cover 30 and use. The part of tissue cover 30 adjacent mounting plate 22 is open to permit easy change of tissue box 35.

Tissue box 35 can contain any suitable disposable material. In fact paper towels can be used and provide for dual function of drying the hands and opening the door, while at the same time conserving space.

Within mounting plate 22 are at least two mounting plate apertures 40 which align with a corresponding door aperture 42 to receive mounting bolts 44. Mounting nuts 46 hold mount bolts 44 in place and thereby secure sanitary door protector 20 to door 12.

Receptacle 50 is mounted below door handle 18. Like tissue cover 30, receptacle 50 has an arcuate front 51. Flat receptacle side 52 fits on mounting plate 22 by means of pin apertures 54. Pin apertures 54 receive mounting pins 56 which are secured to mounting plate 22, so that receptacle 50 may be easily removed and emptied. Receptacle 50 also has a vented bottom 58 so that air may flow therethrough.

Situated within flat receptacle side 52 is receptacle vent 60 which aligns with lower door vent 16 to permit airflow therethrough. Vent deflector 62 as a part of flat receptacle side 52 directs the airflow downwardly and assists disposed tissue to the receptacle 50.

Thus, the sanitary door protector 20 can serve a multitude of functions. Assuming, for example, that disposable hand towels are used in tissue cover 30, hand drying and door handle protection are available in one unit. Additionally after the door is opened, the disposing of the towel merely requires letting go to have the towel drop into receptacle 50. Airflow through the recpetacle air vent 60 and upper door vent 14 contribute thereto.

The sanitary door protector 20 of this invention can be made of any suitable material capable of withstanding the heavy use to which it will be put. Both synthetic resins and metal, along with mixtures thereof are suitable materials.

Other operable modification exist to achieve the purposes of this invetion. For example, tissue box 35 may be mounted on an embossed portion directly secured to mounting plate 22. Further, door handle 18 may be eliminated and replaced with a push plate. Door handle 18 may also be secured to an embossed portion of mounting plate 22 and eliminate the need for door handle aperture 24. Receptacle 50 may be secured to mounting plate 22 by means of a coordinated male-female groove arrangement.

Because of the disclosure herein, modifications can become apparent to those having ordinary skill in this art. It is clear that such apparent modifications are covered hereby.

What is claimed and sought to be secured by Letters Patent of the United States is:

1. A door, and combination receptacle and dispenser for use with said door to improve sanitary conditions around said door, said combination receptacle and dispenser being secured to said door and comprising in combination a mounting plate secured to said door, a dispensing means secured to a first end of said mounting plate and a receiving means removably secured to a second end of said mounting plate, wherein;

(a) said mounting plate includes a handle receiving means between said first end and said second end;
(b) said dispensing means includes an outer cover;
(c) said dispensing means further includes a means for holding a dispenser of a disposable paper product in a position to be covered by said outer cover; and
(d) said dispensing means further includes a means for removably securing said receiving means to said mounting plate.

2. The door and combination receptacle and dispenser of claim 1 wherein said outer cover is hingedly connected to said mounting plate at a top portion of said first end.

3. The door and combination receptacle and dispenser of claim 2 wherein an inner dispenser is mounted within said outer cover in order to hold a disposable paper product in position for use.

4. The door and combination receptacle and dispenser of claim 3 wherein said receiving means includes a vented bottom and at least one mounting aperture for securing said receiving means to said mounting plate.

5. The door and combination receptacle and dispenser of claim 4 wherein said outer cover is removably secured to said mounting plate.

6. The door and combination receptacle and dispenser of claim 5 said door includes at least one door vent and said mounting plate includes a plate vent to communicate with said door vent.

7. The door and combination receptacle and dispenser of claim 6 wherein said door has an upper door vent and said mounting plate has an upper plate vent communicating with said upper door vent and said dispenser; and said door further has a lower door vent and said mounting plate has a lower plate vent communicating with said lower door vent and said receptacle.

8. The door and combination receptacle and dispenser of claim 7 wherein said dispenser includes a support for a disposable paper product secured to said mounting plate.

9. The door and combination receptacle and dispenser of claim 1 wherein:

(a) said mounting plate includes;
  (1) a top plate vent adjacent said dispensing means cooperating with a top door vent in said door,
  (2) a bottom plate vent adjacent said receiving means cooperating with a bottom door vent in said door, and
  (3) said handle receiving means between said bottom vent and said top vent;
(b) said dispensing means includes;

(1) said outer cover being hingedly connected to said mounting plate at a top portion thereof, (2) an inner dispenser within said outer cover for holding a disposable paper product, said inner dispenser being secured to said outer cover, (3) said inner dispenser being between said top plate vent and said door opening means, (4) said outer cover having a downwardly-sloped, substantially flat top extending downwardly from said top portion and forming an acute angle with said mounting plate, (5) an arcuate outer cover front portion extending downwardly from said sloped top and contacting said mounting plate at each of two edges thereof, and (6) said inner dispenser is secured to said arcuate front portion at an arc edge opposite said sloped top;

(c) said receiving means includes;

(1) a tubular receptacle having an open end and a closed end, (2) a flat side for said tubular receptacle extending completely between said open end and said closed end, (3) an arcuate receptacle front secured to said flat side between said closed end and said open end to thereby complete the formation of said tubular receptacle, and (4) a pair of oppositely disposed mounting apertures in said flat side adjacent said open end, said mounting apertures receiving mounting pins secured to said mounting plate to thereby secure said receptacle to said mounting plate in a removable fashion; and (d) said door includes;

(1) door bolt apertures to correspond with mounting plate bolt apertures for bolting said mounting plate to said door, and (2) vent covers secured to said door on a side of said door opposite said mounting plate said top door vent and said bottom door vent.

* * * * *